US005582472A

United States Patent [19]

Lyons et al.

[11] Patent Number: 5,582,472

[45] Date of Patent: Dec. 10, 1996

[54] SOLVENT STORAGE CABINET

[75] Inventors: S. Ross Lyons, Huntersville; Kurt Rindoks, Davidson, both of N.C.

[73] Assignee: Kewaunee Scientific Corporation, Statesville, N.C.

[21] Appl. No.: 447,266

[22] Filed: May 22, 1995

[51] Int. Cl.[6] ..... A47B 88/00

[52] U.S. Cl. ..... 312/324; 312/294; 49/7; 49/8; 49/367; 49/395; 292/238

[58] Field of Search ..... 312/326, 324, 312/325, 326, 329, 400; 49/7, 8, 367, 368, 369, 395; 292/19, 38, 84

[56] References Cited

U.S. PATENT DOCUMENTS

| | | | |
|---|---|---|---|
| Re. 27,066 | 2/1971 | Williams | 49/7 X |
| 1,552,690 | 9/1925 | Frantz | 292/38 X |
| 1,618,551 | 2/1927 | Perry et al. | 49/7 |
| 2,022,718 | 12/1935 | Heins | 292/38 |
| 2,283,537 | 5/1952 | Burnham | 49/8 |
| 3,383,796 | 5/1968 | Frederick, Jr. et al. | 49/7 |
| 3,623,785 | 11/1971 | Williams | 312/294 |
| 3,779,004 | 12/1973 | Gloeckler | 49/8 X |
| 3,822,506 | 7/1974 | Fishbach | 49/367 |
| 3,894,356 | 7/1995 | Imhoff . | |
| 3,895,849 | 7/1995 | Zehr | 312/324 |
| 3,910,611 | 10/1975 | Slovensky, Jr. | 292/38 |
| 4,131,769 | 12/1978 | Davis | 292/38 X |
| 4,146,994 | 4/1979 | Williams . | |
| 4,191,412 | 3/1980 | LeKander . | |
| 4,262,448 | 4/1981 | Flider . | |
| 4,265,051 | 5/1981 | Williams . | |
| 4,288,944 | 9/1981 | Donovan | 49/395 |
| 4,398,371 | 8/1983 | Jenkins | 49/7 |
| 4,583,324 | 4/1986 | Storz et al. | 49/367 |
| 4,619,076 | 10/1986 | Livingston . | |
| 4,653,229 | 3/1987 | Feuch et al. | 49/367 |
| 4,949,505 | 8/1990 | Cohrs . | |
| 4,967,512 | 11/1990 | Schröder et al. . | |
| 4,997,118 | 3/1991 | Uebach et al. . | |
| 5,033,234 | 7/1991 | Simon et al. . | |
| 5,061,022 | 10/1991 | Meriwether . | |
| 5,333,920 | 8/1994 | de Rover . | |

FOREIGN PATENT DOCUMENTS

| | | | |
|---|---|---|---|
| 745993 | 3/1956 | United Kingdom | 49/367 |

*Primary Examiner*—Peter M. Cuomo
*Assistant Examiner*—Rodney B. White
*Attorney, Agent, or Firm*—Hill, Steadman & Simpson

[57] ABSTRACT

An improved storage cabinet is provided which is particularly suitable for the safe storage of flammable materials. An embodiment of the cabinet includes two side-by-side doors which close toward each other. Each door is self-closing, being biased in a closed position by a spring. For convenience, each door can be retained in an open position by a chain. The chain includes a fusible link which melts in the presence of a dangerous level of heat, allowing the associated door to close. In order to protect the interior, the doors have overlapping edges. Accordingly, the cabinet has a closing synchronization mechanism which causes the dual doors to close in a predetermined order. Sequential closing is necessary to effect a proper overlapping of door edges, providing a heat shield. Furthermore, the doors are self-latching, as one door has an independent, three-point latching arrangement which engages the cabinet housing at the top and bottom as well as the first-closed door.

25 Claims, 7 Drawing Sheets

20
22
24
25
28
30
60
62
64
66
68
70
72
74
76
78
80
82
96
98
VII

SOLVENT STORAGE CABINET

BACKGROUND OF THE INVENTION

The present invention generally relates to cabinets. More specifically, the present invention relates to a cabinet suitable for protecting flammable contents from fire to prevent combustion.

Solvents, paints, and other flammable compounds must be carefully stored, particularly in industrial environments. In fact, such storage is required to meet specific requirements and specifications, such as those set forth by the National Fire Protection Association, the Uniform Fire Code (adopted by many states) and OSHA. For example, such regulations presently dictate heat resistance, venting rates and means, leakage control, construction of cabinet walls, external warning signs, self-closing and self latching doors, etc. In order to comply with the regulations for proper storage of flammable and combustible liquids, cabinets are known which provide various safeguards.

For example, U.S. Pat. No. 5,06 1,022 relates to a cabinet having insulated doors with a mechanism for automatically controlling the door closing sequence, ensuring proper overlap of extending lips. Furthermore, this patent discloses a door stay having a fusible link which melts in the presence of high temperatures, thereby automatically closing the doors, if open, in the event of fire.

Unfortunately, known sequential door closing mechanisms typically have numerous moving parts. This increases manufacturing expense and reduces reliability. Furthermore, conventional protective cabinets allow only a restricted range of motion of the doors. More specifically, such cabinets having a side-by-side dual door arrangement do not allow the doors to fully open180°.

Also, cabinets are known having a dual-panel folding door. In such a conventional dual-fold door arrangement, the open, folded doors extend forward 90° from the front surface of the cabinet when opened. Jutting forward in this manner, such folding doors can render access to a cabinet awkward.

SUMMARY OF THE INVENTION

The present invention provides an improved flammable-liquid storage cabinet which complies with all present fire codes and which overcomes problems associated with conventional cabinets. The cabinet advantageously utilizes a simple but reliable and effective door closing synchronization mechanism which allows a dual set of doors to close in a predetermined order. Sequential closing is necessary to effect a proper overlapping of door edges, providing a heat shield. Furthermore, the cabinet of the present invention provides improved self-closing and automatic self-latching mechanism.

To this end, the present invention provides a cabinet having a housing with an opening, the opening generally occupying a plane. The cabinet also includes a first door and a second door which are hingeably closeable toward each other to close the opening. The cabinet also includes a rod which is rotationally secured to the housing. The rod is pivotable between a first position and a second position. The rod includes a first projection which is extendable into the plane when the rod is in the first position such that when the first door closes against the first projection, the rod is caused to rotate from the first position to the second position. The rod also includes a second projection which extends into the plane to hold the second door ajar when the rod is in the first position. The second projection pivots out of the plane when the rod rotates to the second position so that the second door is allowed to close when the first door hits the first projection, preventing the second door from closing while the first door is open.

In an embodiment, each door is hingeably pivotable approximately 180° or more.

In an embodiment, each door comprises a hinge pivotable connecting the door to the housing. A rotational spring is secured to the housing and has a moveable, biased arm. A connecting arm has an end pivotally secured to the door and an opposite end pivotally secured to the arm of the rotational spring. The connecting arm can be straight or, in an embodiment, the connecting arm can be curved or otherwise shaped to clear the door and the housing when the door is open 180°. Each rotational spring biases the door in a closing direction.

In an embodiment, a chain having at least one fusible link is provided for each door. The chain is securable between one of the doors and the linkage connecting the door and the rotational spring to hold the door in an open position. The fusible link melts in the presence of extreme heat or fire, allowing the door to close.

In an embodiment the doors have overlapping edges. Particularly, an astragal or first lip on the first door extends toward the second door. The cabinet also includes a second lip on the second door extending toward the first door. When both doors are closed, the astragal or first lip lies over an interiorly facing side of the second lip, i.e., the second lip overlaps the astragal.

An advantage of the present invention is to provide an improved cabinet for the safe storage of flammable materials.

Another advantage of the present invention is to provide a cabinet having an improved mechanism for controlling the sequential closing of doors.

A further advantage of the present invention is to provide a cabinet wherein the doors can be fully opened 180° (e.g., or more) for convenient access to the cabinet interior.

Yet another advantage of the present invention is to provide a cabinet having an improved self-latching mechanism.

A still further advantage of the present invention is to provide a cabinet wherein the doors conveniently remain open, but which automatically close in the presence of dangerous heat exposure.

Additional features and advantages of the present invention are described in, and will be apparent from, the detailed description of the presently preferred embodiments and from the drawings.

BRIEF DESCRIPTION OF THE DRAWINGS

FIG. 11 shows the chain holding the door open, and FIG. 12 shows the fusible link broken.

DETAILED DESCRIPTION OF THE PRESENTLY PREFERRED EMBODIMENTS

The present invention provides a fireproof cabinet for the storage of flammable materials, such as solvents and the like. The cabinet is self-closing and self-latching in the presence of internal or external heat to either contain a fire within the cabinet or to keep materials inside the cabinet from combusting from an external fire.

Figure 1:
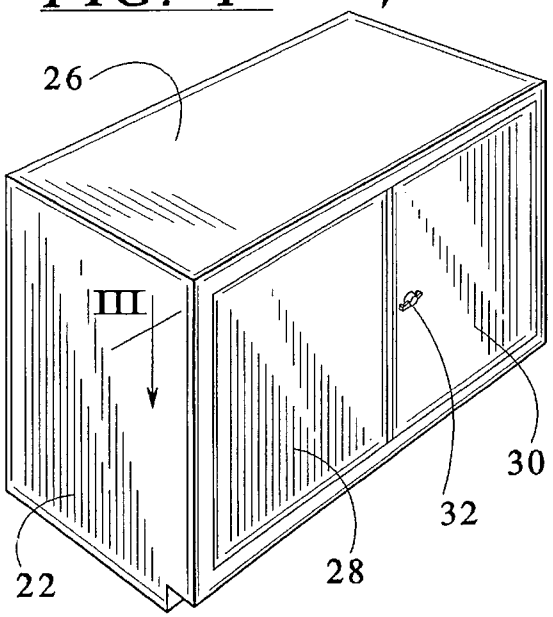
FIG. 1 illustrates a perspective view of a cabinet according to the present invention.
Figures 3, 4, 5, 6:
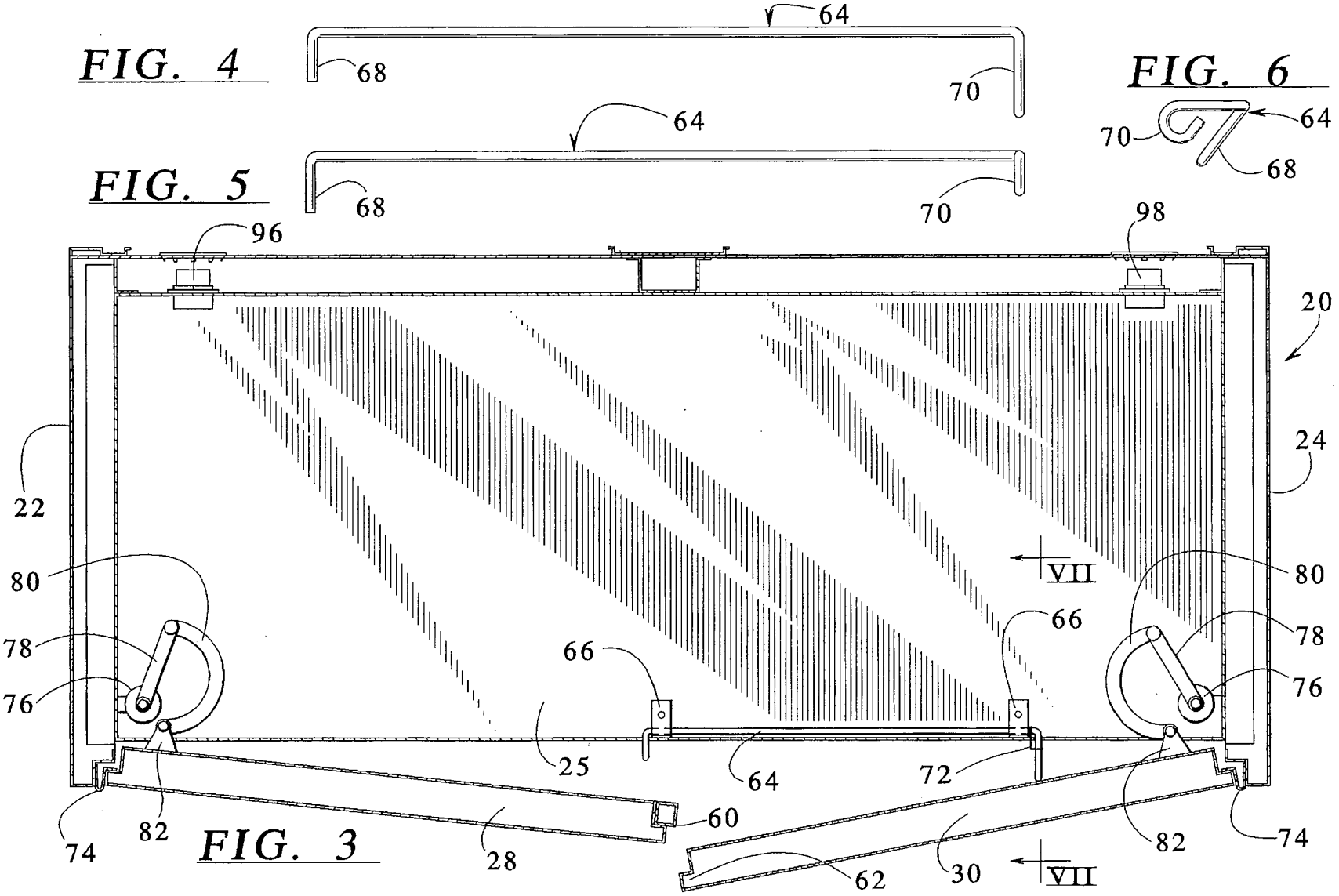
FIG. 3 illustrates a top sectional view of the cabinet of FIG. 1, taken generally along line III—III of FIG. 1.
FIG. 4 illustrates a top view of a bent synchronization rod according to the present invention.
FIG. 5 illustrates a front view of the rod of FIG. 3.
FIG. 6 illustrates a side view of the rod of FIGS. 3 and 4.

Turning to the, FIGS. 1 and 3 illustrate a cabinet 20 embodying features of the present invention. The cabinet 20 includes a rectangular enclosure or housing with side panels 22 and 24, a top panel 26, a bottom panel 25, a rear panel 27, and a front opening closeable by first and second doors 28 and 30, respectively. The front opening is defined by the top 26, bottom 25, and side panels 24 to receive the closed doors 28, 30 in a frame-like manner. The cabinet 20 is preferably constructed of double walled steel for fire resistance and insulating properties. Furthermore, insulation 100 is preferably provided between each wall of each panel 22, 24, 25, 26, 27 of the cabinet 20 and within each door 28, 30. The insulation 100 provides additional heat resistance. The second door 30 is provided with a knob 32 which actuates a self-latching mechanism.

Figure 2:
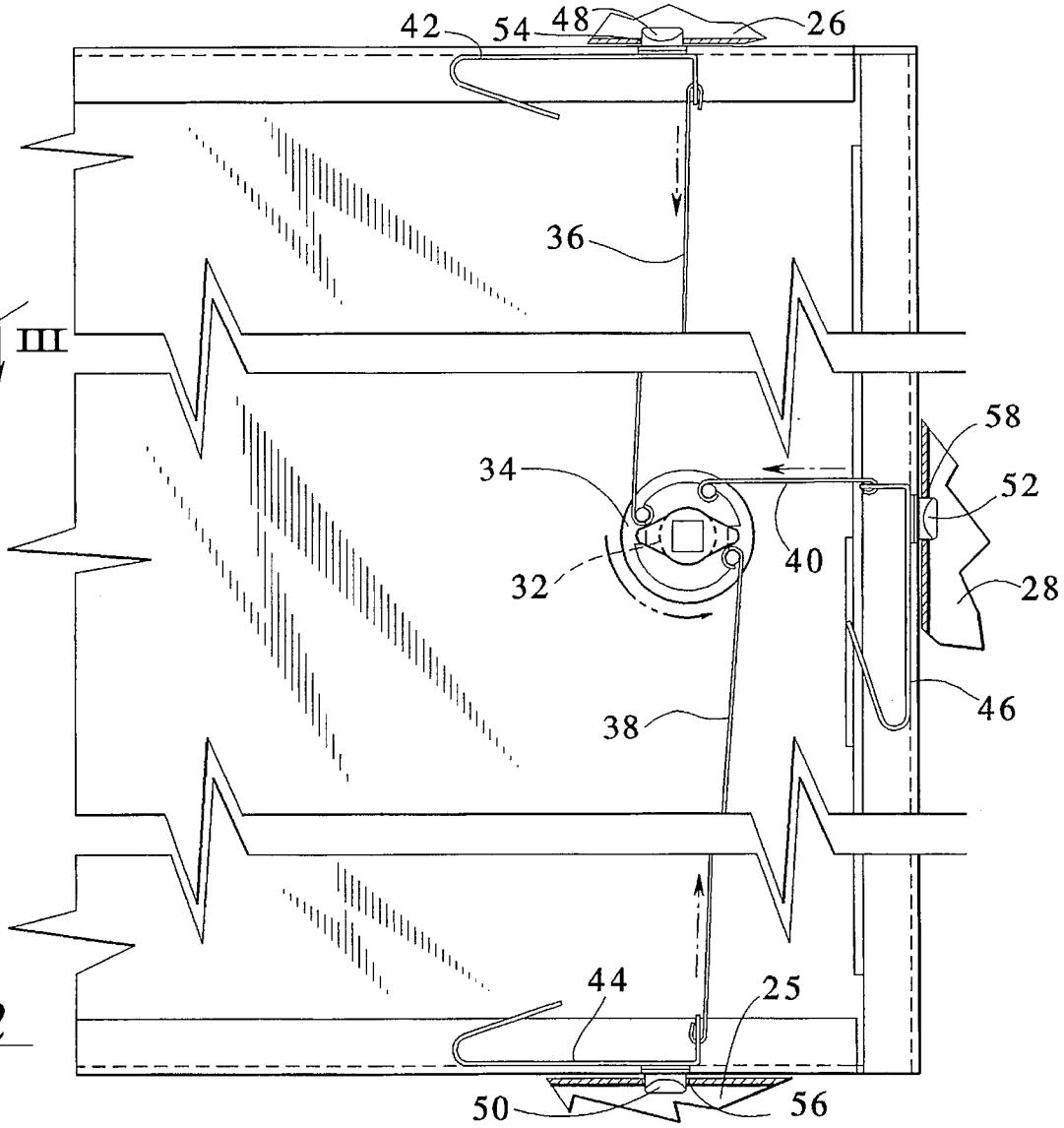
FIG. 2 illustrates a fragmentary rear sectional view of the right door, showing the latching mechanism.

The self-latching mechanism is illustrated in FIG. 2. The knob 32 is secured to a rotatable cam 34. Top, bottom, and side links or wires 36, 38, 40 are connected to the cam 34. An opposite end of each wire 36, 38, 40 is respectively secured to a free end of a top, bottom and side flat latch spring or leaf spring 42, 44, and 46, respectively. The self-latching mechanism is preferably a three-point system, one of the latch springs being disposed at respective top, bottom and center side of the second door 30. The free end of each latch spring 42, 44, 46 has a beveled catch member or catch head 48, 50 and 52, respectively secured thereto, each spring 42, 44, 46 biasing its respective catch head to extend through a wall of the door 30. The top and bottom catch heads 48, 50 are received in cooperatively shaped top and bottom latch holes 54, 56 in the housing, and the side catch head 52 is received in a cooperatively shaped latch hole 58 in the first door 28. When the knob 32 is rotated, the cam 34 rotates in the direction indicated by the arrow in FIG. 2. This rotation of the cam 34 tangentially pulls on each wire, 36, 38, 40, pulling the respective latch springs inwardly, 42, 44, 46 as indicated by arrows, retracting each catch head 48, 50, 52 simultaneously. The end of each catch spring opposite its respective catch member is secured to a wall of the second door 30.

The catch heads 48, 50, 52 are each independently deflectable to self-latch the second door. Thus, when the second door 30 is slammed shut, each catch head 48, 50, 52 deflects inwardly on its respective latch spring 42, 44, 46 to engage the respective latch hole 54, 56, 58. Each wire 36, 38, 40 can be engaged in a slot in the respective latch spring 42, 44, 46 to permit this independent relative movement. In an embodiment, the wires 36, 38, 40 could be flexible cables linking the cam motion to the spring, but in such an embodiment, a slotted connection is not necessary. The cam 34 is rotatable to cause tension simultaneously in each wire 36, 38, 40, retracting each catch head 48, 50, 52 free from its latch hole 54, 56, 58 to open the doors. Also, the biasing of the leaf-type latch springs 42, 44, 46 causes the cam 34 and associated knob 32 to return to an active self-latching position when the knob 32 is released by a user.

The first and second doors 28, 30 are shaped to overlap the housing along the top, bottom, and sides. Furthermore, as shown in FIG. 3, the first and second doors 28, 30 are shaped to overlap each other. More specifically, the first door 28 has an astragal or first lip 60 which extends toward the second door 30, where it is received against an interior side of a lip 62 of the second door. Similarly, the second door 30 has the second lip 62 which extends toward the first door 28 in an exteriorly overlapping manner. Thus, for proper shielding and sealing effectiveness of the overlapping door lips 60, 62 when the doors 28, 30 are closed, the first door 28 must be closed before the second door 30. In order to assure this closing sequence, the cabinet 20 includes a pivotable rod 64. As shown, the rod 64 is pivotally secured inside the top panel 26 by a pair of tabs 66 which are partially looped over the rod 64.

A pair of vents 96 and 98 are preferably provided in the rear panel 27. The vents 96 and 98 are generally located at diagonally opposed corners of the rear panel.

The rod 64 has a first projection 68 at one end and a second projection 70 at an opposite end, as illustrated in FIGS. 3–6. The rod 64 is pivotable between a first position or interfering position (as shown in FIG. 3) wherein the second projection 70 generally extends horizontally forward, and a second position or noninterfering position (FIG. 10) wherein the second projection 70 extends generally vertically downward. A rotational spring 72 is provided to bias the rod 64 in the first position. The second projection 70 has a rounded end bent in a teardrop shape. The first projection 68 has a tip which is rounded.

Figure 8:
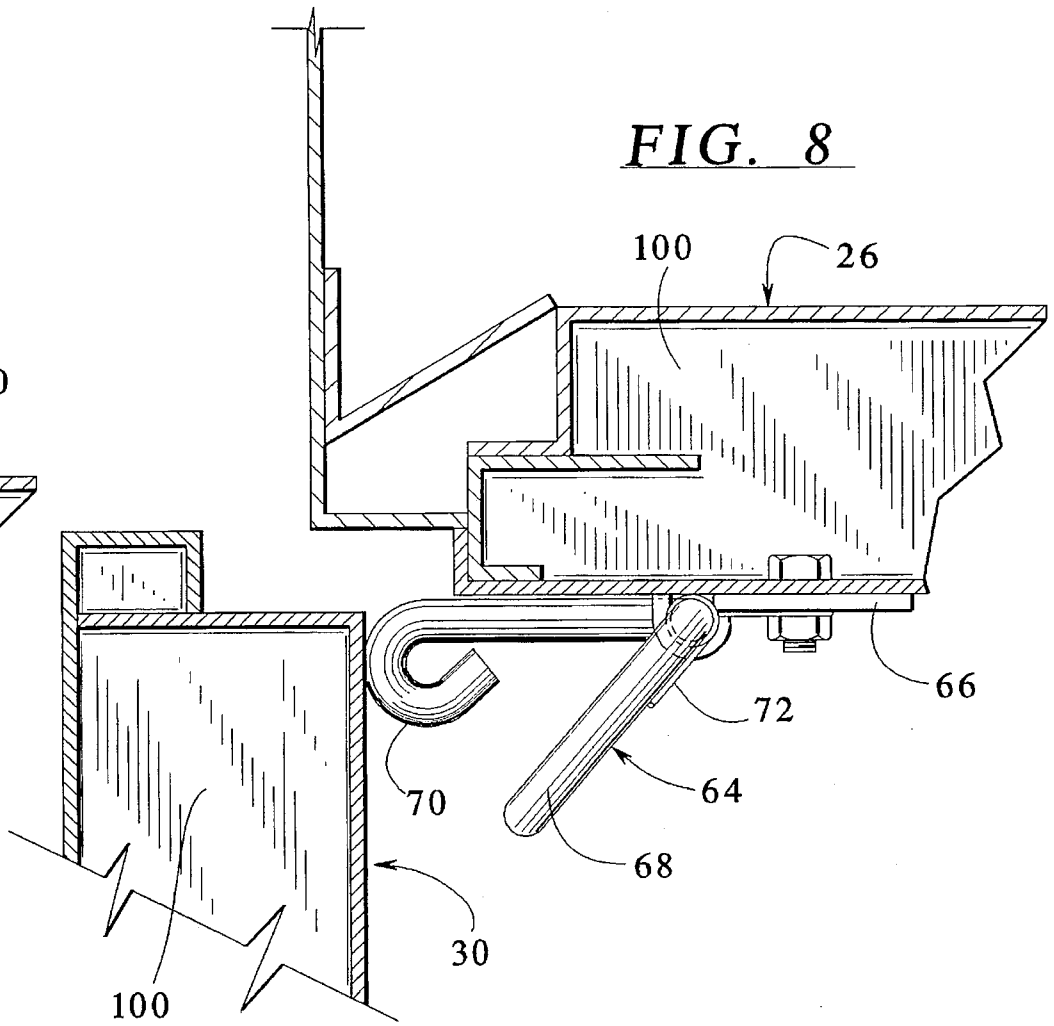
FIGS. 7–10, each illustrates an enlarged fragmentary sectional view taken generally along VII—VII of FIG. 2, showing various stages of operation of the door closing synchronization mechanism.
Figure 7:
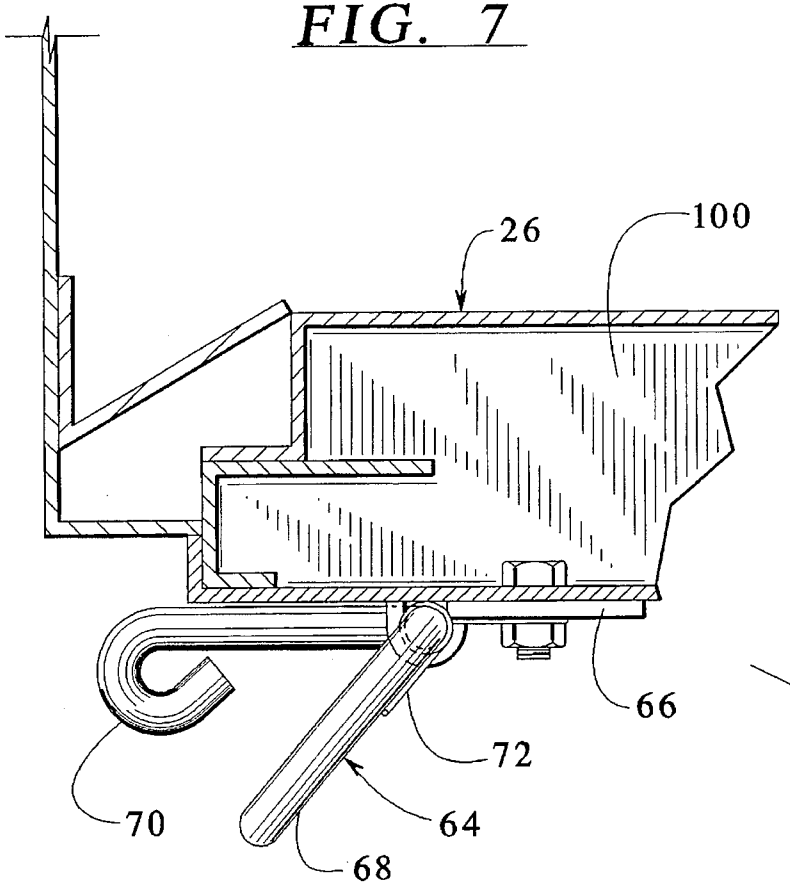
Figure 10:
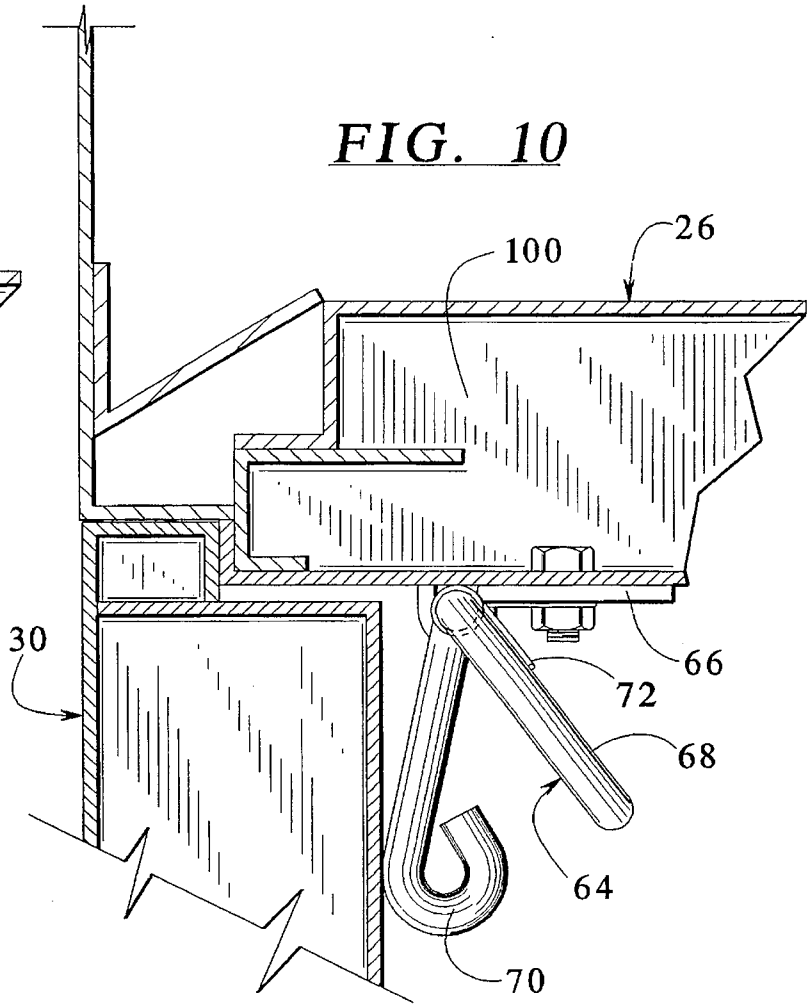
Figure 9:
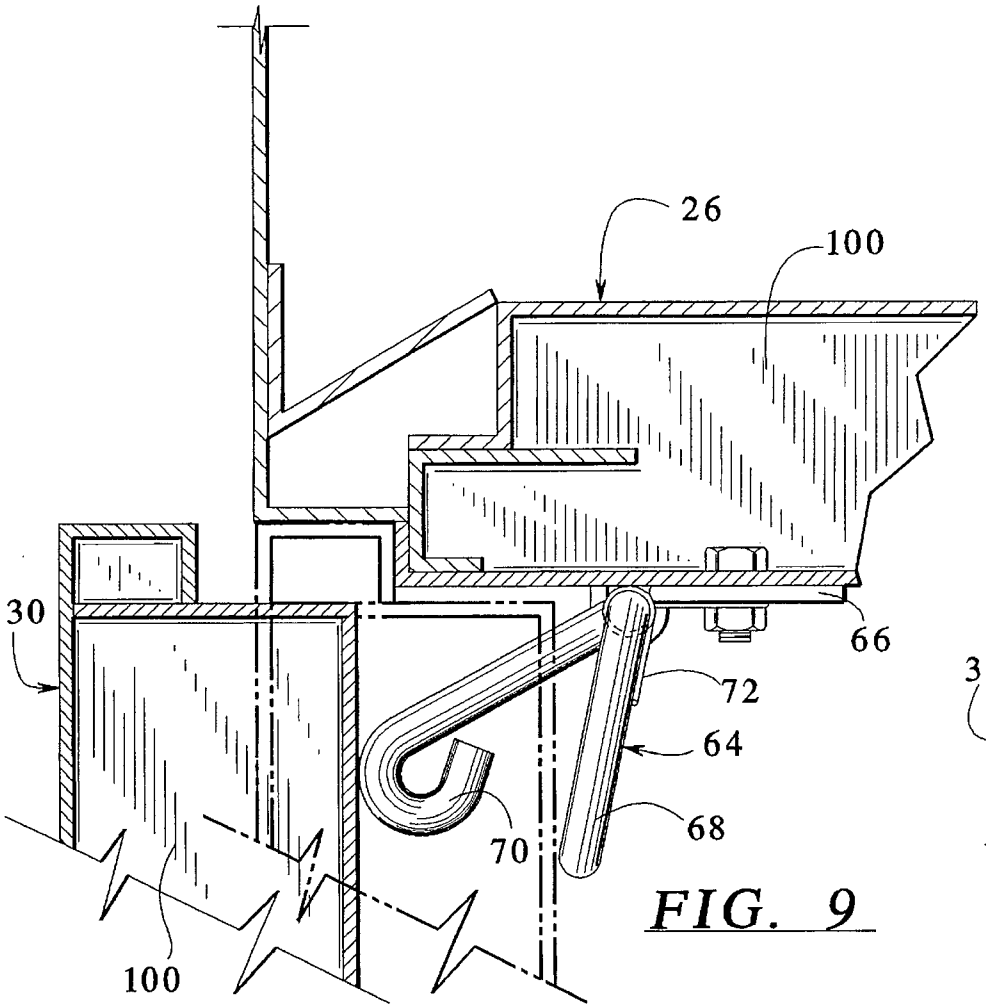

When the rod 64 is in the first position, as shown in FIGS. 3, 7 and 8, the second door 30 cannot close. Rather, the second projection 70 contacts against the second door 30, holding it ajar, as shown in FIGS. 3 and 8. The second door 30 is held ajar to an extent necessary to provide clearance allowing the first door 28 to close against the first projection 68. As illustrated in FIGS. 6–8, the first projection 68 is angled downwardly and forwardly when the rod 64 is in the first position. This angled configuration provides rotational leverage on the rod 64 when the first projection 68 is struck by the first door 28. Consequently, when the first door 28 closes against the first projection 68, the rod 64 rotates from the first position to the second position, as illustrated in FIGS. 9 and 10, rotating the second projection 70 from the second door 30, allowing the second door 30 to close. The rounded end of the second projection 70 slides downward on the second door 30 during the rotation of the rod 64.

When the first and second doors 28, 30 are closed, the beveled catch members 48, 50, 52 (FIG. 2) of the second door 30 latch into their respective latch holes 54, 56, 58, securing the doors 28, 30 in a closed position. The sequential closing caused by the rod 64 ensures that the second door 30, which closes last, is fully seated in order to engage each catch member 48, 50, 52.

Figure 11:
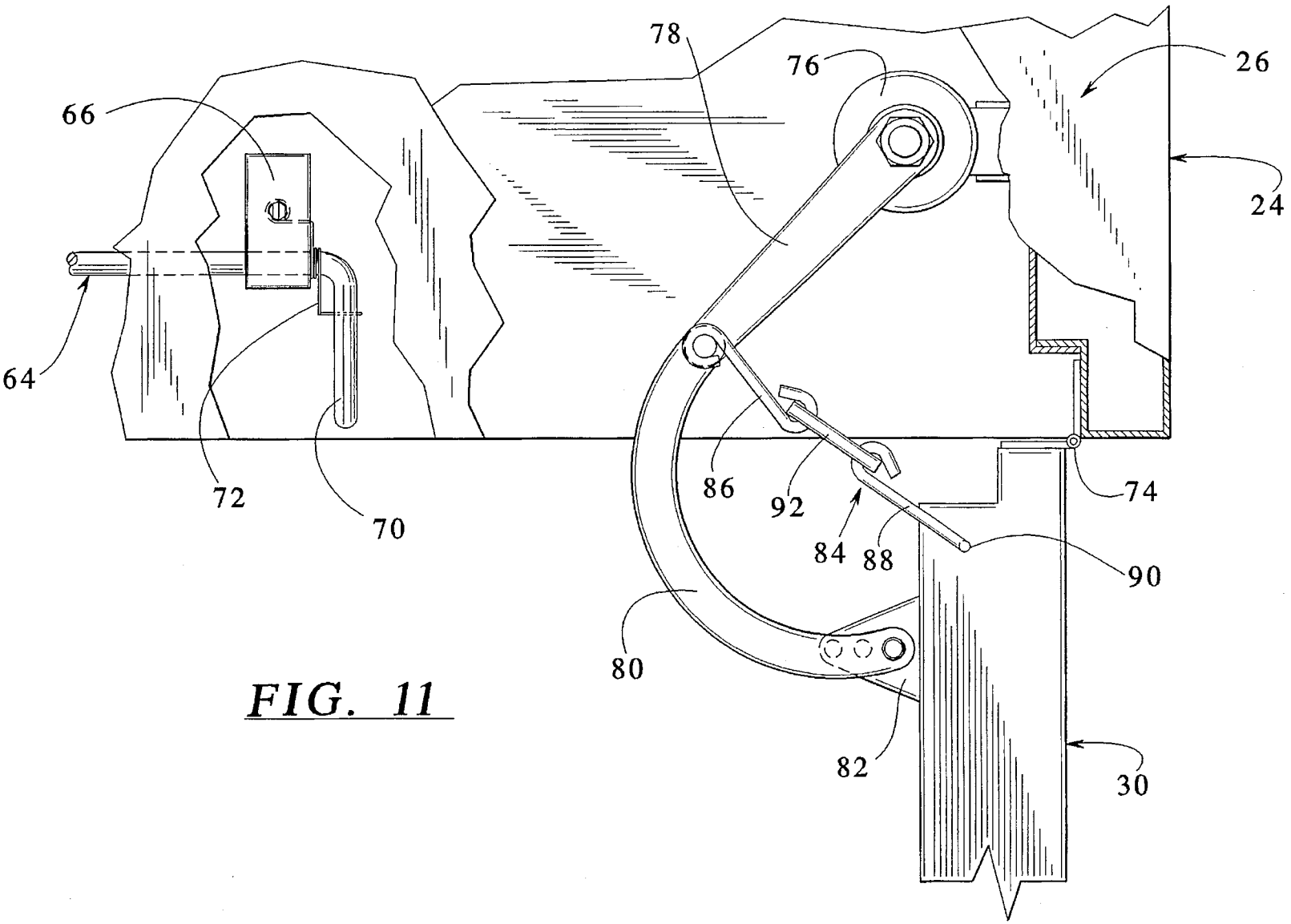
FIGS. 11 and 12 each illustrate a fragmentary top sectional view depicting detail of the door hinge mechanism according to the present invention.
Figure 12:
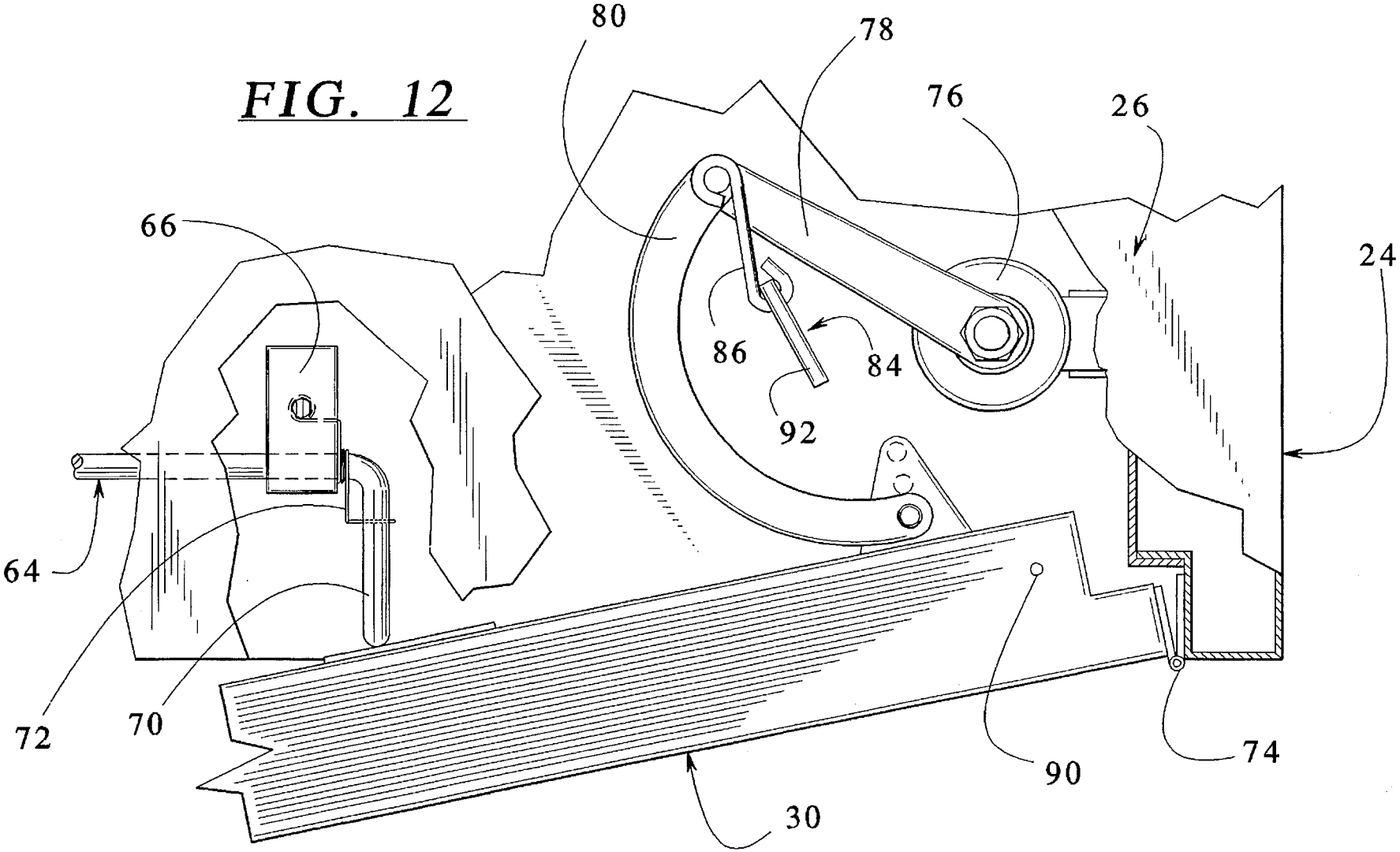

FIGS. 3, 11, and 12 illustrate the self-closing hinge mechanism according to an embodiment of the present invention. Each door 28, 30 is pivotally mounted to its respective adjacent side panel 22, 24 by a hinge 74. A rotational spring 76 is secured to an interior of the housing, against the respective side panel 22, 24 proximally to the door. The rotational spring 76 includes a biased arm 78. A connecting arm 80 has one end pivotally secured to the biased arm 78 and an opposite end pivotally secured to a bracket 82 extending from the associated door 28, 30. The connecting arm is preferably curved or otherwise shaped with a bend. The preferred shape of the connecting arm 80 is dimensioned such that the associated door 28 or 30 can be opened about 180°. The curvature provides clearance of the door 28, 30 and the respective side panel 22 or 24 in the folding area of the hinge 74. The rotational spring 76 biases the biased arm 78 inwardly, biasing the associated door 28, 30 to a closed position.

In the illustration of FIG. 11, the door 30 is open 90°. A chain 84 is provided for each door 28, 30 to retain the associated door 28 or 30 in an open position (only chain 84 associated with the second door 30 is shown). The chain 84 generally includes a first metal link 86 which is secured at the pivotable connection between the biased arm 78 and the connecting arm 80. The chain 84 further includes a second metal link 88 which hooks into a properly positioned hole 90 in the top of the door 30. The first and second metal links 86 and 88 are connected by a fusible link 92. When the second metal link 88 is hooked into the door 30, as shown, tension in the chain 84 reduces the leverage of the biased arm 78 against the connecting arm 80, such that the door 30 remains open 90°. The chain 84 could be arranged differently to hold the door 30 at another angle.

The second metal link 88 normally hangs loosely, the chain 84 only being secured at the first metal link 86. If the cabinet interior must be accessed, a person can simply hook the second metal link 88 into the hole 90 in the door 30, as shown, to provide unencumbered access.

In the presence of extreme heat, the fusible link melts, eliminating the connection between the first metal link and the second metal link. The second metal link is preferably hook-shaped to fall away from the door. Unrestrained by the chain, the door is then biased to close by the rotational spring, as illustrated in FIG. 12.

Although FIGS. 11 and 12 illustrate the self-closing mechanism in association with the second door 30, the first door 28 preferably has a similar arrangement, as shown in FIG. 3.

Figure 13:
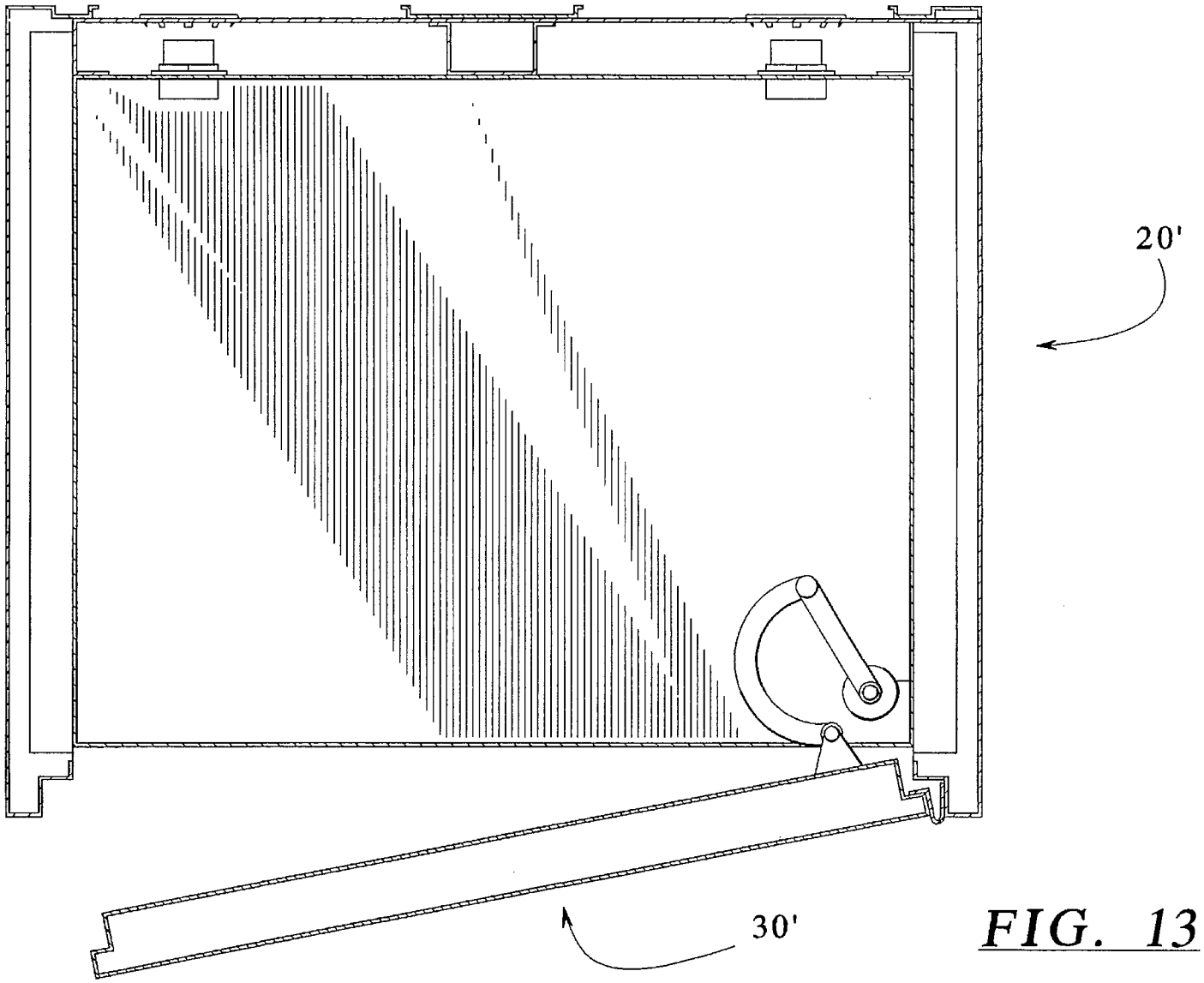
FIG. 13 illustrates a single-door cabinet embodying features of the present invention.

FIG. 13 illustrates an alternative embodiment providing a cabinet 20' with a single door 30'. The cabinet includes a self-closing mechanism such as that described in reference to FIGS. 11 and 12, as well as a self-latching mechanism such as that described in reference to FIG. 2.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed is:

1. A cabinet comprising:

a housing defining an interior and having an opening, the opening occupying a plane;

a first door and a second door hingeably closeable toward each other to close the opening in a partially overlapping manner; and a rod rotationally secured to the housing within said interior, the rod being pivotable about an axis between a first position and a second position, the rod including:

a first projection extendable into the plane when the rod is in the first position such that when the first door closes against the first projection, the rod is caused to rotate from the first position to the second position; and a second projection which extends into the plane to hold the second door ajar when the rod is in said first position, the second projection pivoting out of the plane and being retracted from the plane toward the interior when the rod rotates to the second position so that the second door is allowed to close when the first door hits the first projection, preventing the second door from closing while the first door is open.

2. The cabinet according to claim 1 wherein each door is hingeably pivotable approximately 180° or more.

3. The cabinet according to claim 1 wherein at least one of the doors comprises:

a hinge pivotally connecting the door to the housing;

a rotational spring secured to the housing and having a biased arm; and a connecting arm having an end pivotally secured to the door and an opposite end pivotally secured to the biased arm of the rotational spring, the connecting arm being shaped to clear the door and the housing when the door is opened 180°;

wherein each rotational spring biases the door in a closing direction.

4. The cabinet according to claim 3 further comprising:

a chain having at least one fusible link, the chain being securable between the door and the housing to hold the door in an open position, the fusible link melting at a predetermined temperature to allow the door to close.

5. The cabinet according to claim 1 wherein the first and second doors overlap each other, the second door having a portion which exteriorly overlaps the first door when the doors are closed.

6. The cabinet according to claim 1 further comprising:

a rotational spring which biases the rod in the first position.

7. The cabinet according to claim 1 including a latching mechanism disposed in the second door, the latching mechanism comprising:

a knob accessible from an exterior side of the second door, a cam secured to the knob, the cam being rotatably secured to the second door;

at least one leaf spring having a fixed end secured to the second door, the leaf spring having a free end opposite the fixed end;

a beveled catch [head]member secured to the free end, the catch member being biased by the leaf spring to extend through the door; and a link secured to the free end and to the cam so that when the cam is rotated, the leaf spring is resiliently deflected, retracting the catch member.

8. The cabinet according to claim 7 wherein the link is a stiff wire.

9. The cabinet according to claim 7 wherein there are three leaf springs with associated catch members and links, one at a top and one at a bottom of the second door, and one at a side of the second door facing the first door.

10. A cabinet comprising:

an enclosure having a front opening;

a first door and a second door arranged in a side-by-side manner and being hingeable toward one another to close the opening, the second door partially overlapping the first door on an exterior side; and a rod pivotally secured internally within said enclosure, the rod being pivotable between an interfering position and a noninterfering position, the rod having a first projection and a second projection such that in the interfering position the second projection holds the second door ajar, allowing clearance for the first door to close onto the first projection, contact by the first door against the first projection causing the rod to pivot inwardly into the enclosure to the noninterfering position whereby the second projection is pivoted inwardly into the enclosure away from the second door, allowing the second door to close only when the first door is closed.

11. The cabinet according to claim 10 further comprising:

a spring associated with each door, biasing the respective door in a closed position.

12. The cabinet according to claim 11 wherein each spring is secured to the enclosure, the cabinet further comprising:

a connecting arm associated with each spring, each connecting arm linking the respective spring to the respective door, each connecting arm having a shape allowing the respective door to be opened approximately 180°.

13. The cabinet according to claim 11 further comprising:

a chain associated with each door, the chain being connectable to hold the respective door in an open position; each chain including a fusible link which melts at a predetermined temperature to allow the door to close.

14. The cabinet according to claim 10 including a latching mechanism disposed in the second door, the latching mechanism comprising:

a knob accessible from an exterior side of the second door, a cam secured to the knob, the cam being rotatably secured to the second door;

at least one leaf spring having a fixed end secured to the second door, the leaf spring having a free end opposite the fixed end;

a beveled catch head secured to the free end, the catch head being biased by the leaf spring to extend through the door; and a link operably connecting the free end to the cam so that when the cam is rotated, the leaf spring is resiliently deflected, retracting the catch head.

15. The cabinet according to claim 14 wherein the link is a stiff wire.

16. The cabinet according to claim 14 wherein there are three leaf springs with associated catch heads and links, one at the top and one at the bottom of the second door, and one at the side of the second door facing the first door.

17. The cabinet according to claim 10 wherein the enclosure, first door and second door are constructed of double-walled steel.

18. The cabinet according to claim 10 wherein the enclosure includes a back panel opposite the front opening, the cabinet further comprising:

a pair of vents one being disposed at a top corner, the other being disposed at a diagonally opposite bottom corner.

19. A self-closing cabinet comprising:

a housing defining an interior, the housing having an opening;

at least one door to close the opening;

a hinge pivotally connecting the door to the housing;

a rotational spring associated with said door, the rotational spring being secured to the housing and having a biased arm; and a connecting arm having an end pivotally secured to the door and an opposite end pivotally secured to the arm of the rotational spring;

wherein each rotational spring biases the associated door in a closing direction and wherein the connecting arm is shaped to clear the door and the housing when the associated door is opened 180°.

20. The cabinet according to claim 19 wherein there is a single door.

21. The cabinet according to claim 19 wherein there are two doors.

22. The cabinet according to claim 19 further comprising:

a chain associated with each rotational spring, the chain being connectable to hold the associated door in an open position; each chain including a fusible link which melts at a predetermined temperature to allow the door to close.

23. A self-latching cabinet comprising:

a housing having an opening;

at least one door secured to the housing on a hinge to close the opening;

a knob associated with one of the doors, the knob being accessible from an exterior side of the associated door;

a cam secured to the knob, the cam being rotatably secured to the associated door;

at least one leaf spring having a fixed end secured to the associated door, the leaf spring having a free end opposite the fixed end;

a beveled catch member secured to the free end, the catch member being normally biased by the respective leaf spring to extend through the associated door to engage a latch hole; and a link operably respectively connecting the free end to the cam so that when the cam is rotated, the leaf spring is resiliently deflected, retracting the catch member.

24. The cabinet according to claim 23 wherein there are three leaf springs with associated catch members and links, the leaf springs being disposed so that the catch members respectively extend from the associated door at a top, bottom and a side of the associated door opposite a side at which the hinge is disposed.

25. The cabinet according to claim 24 wherein there are two doors and wherein the catch member extending from the side engages the door other than the associated door.

* * * * *